United States Patent [19]

Prittie

[11] Patent Number: 5,074,209

[45] Date of Patent: Dec. 24, 1991

[54] RAISED IMAGE PLATE CONSTRUCTION WITH REGIONS OF VARYING STIFFNESS UNDER THE IMAGE AREAS

[76] Inventor: Allan R. Prittie, 46 Edenbrook Hill, Islington, Ontario, Canada

[21] Appl. No.: 436,037

[22] Filed: Nov. 14, 1989

[30] Foreign Application Priority Data

Dec. 21, 1988 [GB] United Kingdom ..... 8829802

[51] Int. Cl.[5] ..... B41L 38/00; B41M 9/04

[52] U.S. Cl. ..... 101/395; 101/401.3

[58] Field of Search ..... 101/401.3, 395

[56] References Cited

U.S. PATENT DOCUMENTS

| | | | |
|---|---|---|---|
| 2,133,981 | 10/1938 | Frazier | 101/401.3 X |
| 2,825,282 | 3/1958 | Gergen et al. | 101/401.3 X |
| 3,085,507 | 4/1963 | Kunetka | 101/395 X |
| 3,102,030 | 8/1963 | Hoerner | 101/401.3 X |
| 3,103,168 | 9/1963 | Braznell et al. | 101/401.3 X |
| 3,213,789 | 10/1965 | McIlvaney et al. | 101/401.3 |
| 3,347,162 | 10/1967 | Braznell et al. | 101/395 X |
| 3,391,637 | 7/1968 | Reynolds et al. | 101/401.3 |
| 3,703,362 | 11/1972 | Dustin | 101/401.3 X |
| 3,779,761 | 12/1973 | Dustin | 101/401.3 X |
| 4,078,494 | 3/1978 | Gregory | 101/401.3 X |

*Primary Examiner*—Clifford D. Crowder

*Attorney, Agent, or Firm*—Shoemaker and Mattare, Ltd.

[57] ABSTRACT

In a raised-image printing process, a plate construction includes a plate portion with an upper printing surface for printing an image on a substrate, the image including areas of greater ink coverage and areas of lesser ink coverage. Regions of greater and lesser stiffness are incorporated in the construction such that greater contact pressure is applied under image areas of greater ink coverage, and lesser contact pressure is applied under areas of lesser ink coverage.

1 Claim, 1 Drawing Sheet

RAISED IMAGE PLATE CONSTRUCTION WITH REGIONS OF VARYING STIFFNESS UNDER THE IMAGE AREAS

This invention relates generally to the printing industry, and has to do particularly with an improved construction for a printing plate of relatively low stiffness, or its support, used in the raised plate method of printing (sometimes referred to as the flexographic and/or as the letterpress process).

BACKGROUND OF THIS INVENTION

In accordance with the general terminology utilized in the printing industry, the word "letterpress" refers to a printing procedure in which the locations on the plate where ink is to be deposited are raised with respect to areas where ink is not to be deposited. Within the general designation of letterpress printing, two distinguishable forms can be identified. The first typically utilizes a relatively stiff plate (i.e. employing a material of relatively high stiffness), commonly referred to in the industry as a "hard" plate. "Hard" plate letterpress systems typically employ an impression roll with a compliant coating and one or more form cylinder(s) also with compliant coating(s). The form cylinder may be either directly inked from a well, or remotely inked through a series of rollers. The ink on the form cylinder is transferred to the inking locations on the "hard" plate which is mounted to the plate cylinder. The web or sheet of substrate to be printed is entrained between the impression cylinder and the plate cylinder. The web or sheet of substrate to be printed is entrained between the impression cylinder and the plate cylinder. With a "hard" plate, the impression cylinder must be relatively less stiff, in order to avoid damage due to mechanical interference, and/or to improve the evenness of ink transfer from the printing plate to the substrate to be printed.

The second letterpress category utilizes a printing plate (commonly referred to in the industry as a "soft" plate) whose stiffness is relatively lower; i.e. the raised areas which are to be inked and then transfer the ink to the substrate are relatively less stiff with respect to the relatively more stiff form cylinder(s) and relatively more stiff impression roll (frequently steel).

The term "flexographic" is often utilized to refer to the letterpress system in which a less stiff plate is used, with the other two rollers being relatively more stiff.

In the raised plate printing method the plates are normally made with as uniform a total thickness as is possible.

The printing industry generally recognizes certain inherent problems relating to the raised plate printing method. One of these problems relates to the different contact pressure requirements between the printing surface of the plate and the substrate, depending upon the area of coverage of the ink. It is known that the degree of contact pressure between a plate's surface and the substrate is preferably less for the less covered areas, and more for the more covered areas. When the area less covered includes tiny dots due to the four-colour separation process, it is found generally that the contact pressure necessary to properly print solid-ink areas is too high to allow correct printing of the dotted areas, because excessive contact pressure in the latter tends to expel ink from the space between the paper and the raised dot on the plate, thus forming a ring or doughnut of solid ink around a central zone of inadequate ink coverage. However, if the contact pressure between the plate and the impression roll is reduced to a level which allows a good printing of the dot, it is found that areas of solid ink are inadequately printed, i.e. the ink is not fully and/or properly transferred to the substrate.

It is known to provide, for use with a printing plate, a "make ready" plate which corresponds to the plate in the sense that the "make ready" plate has an increased thickness in the regions corresponding to the more solid ink printing, and a gradually decreasing thickness in proportion to the degree of ink coverage in other regions of the plate. Areas of low ink coverage will include locations where fine copy appears. The "make ready" is positioned under the plate with corresponding areas matched, so that all solid regions will tend to be urged more strongly against the substrate than are the areas which are only partially ink covered. It is understood that this process works to some extent, but not fully. It involves considerable extra expense to fabricate the "make ready" sheet, and it complicates the process of affixing the plate to the plate cylinder. Relative to the affixing of the plate to the plate cylinder, where a plate of relatively low stiffness is utilized without the "make ready plate", it is typical in the industry to use a sheet of two-sided adhesive tape between the plate and the cylinder. Such tape may be very compliant (referred to in the trade as "cushion tape"), incorporating a layer of open or closed cell foam which is usually very low in stiffness. It is also known to use relatively stiff or non-compliant tape. It has been found that, when a low-stiffness tape is used to secure the plate to the plate cylinder, the plate-to-substrate contact pressure drops off too greatly in the locations of high ink coverage (area-wise), while the contact pressure between plate and substrate in the locations of relatively low ink coverage (area-wise) tends to allow more acceptable printing as the dots become smaller. The low-ink coverage areas are referred to as the highlight areas of the four colour printing process. Conversely, when a stiff tape is used, the dot areas extrude ink outwardly to a larger diameter than originally intended, and the locations of heavy ink coverage (area-wise) usually print relatively properly.

GENERAL DESCRIPTION OF THIS INVENTION

In view of the foregoing problem, it is an object of one aspect of this invention to facilitate optimum printing with a raised plate, wherein extra contact pressure is applied between the plate's surface and the substrate under the more solidly inked areas of the plate, with a lesser contact pressure being applied under the partially inked areas. Preferably, the contact pressure applied varies continuously such that it is roughly proportional to the degree of ink coverage. Alternatively, the contact pressure may vary in discrete steps, again roughly proportionately to the degree of ink coverage.

More particularly, this invention provides, for use in a raised image printing process employing a plate cylinder, an improved plate construction comprising:

a plate portion having an upper printing surface for printing an image on a substrate, the image including areas of greater ink coverage and areas of lesser ink coverage, attachment means for attaching the plate portion to the plate cylinder so that said upper printing surface is uniformly spaced above said plate cylinder, and means for providing regions of greater and lesser stiffness between said upper printing surface and said plate cylinder while maintaining the uniform spacing between the upper printing surface and the plate cylinder, said means affecting the contact pressure with which the surface is urged against the substrate, such that greater contact pressure is applied under image areas of greater ink coverage, and lesser contact pressure is applied under areas of lesser ink coverage.

Additionally, this invention provides a method of printing using a raised image printing process in which a plate portion having an upper printing surface prints an image while it is secured to a support surface, said upper printing surface being at a uniform spacing from said support surface, the method comprising providing, between said upper printing surface and the support surface, regions of differing stiffness such that a greater degree of stiffness is provided under image areas of greater ink coverage and a lesser degree of stiffness is provided under image areas of lesser ink coverage, while maintaining said uniform spacing.

GENERAL DESCRIPTION OF THE DRAWINGS

Four embodiments of this invention are illustrated in the accompanying drawings, in which.

DETAILED DESCRIPTION OF THE DRAWINGS

Figure 1:
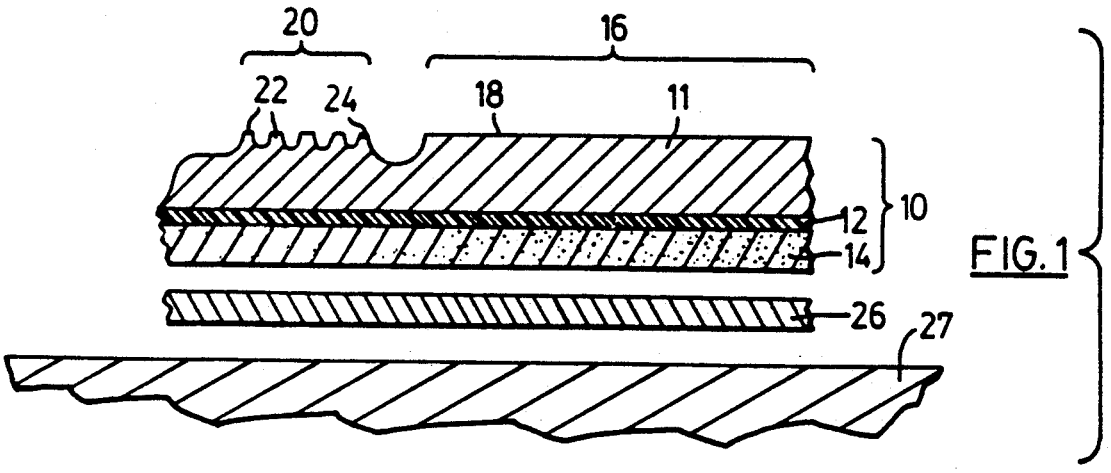
FIG. 1 is a sectional view through a first embodiment of this invention.

The first embodiment of this invention, illustrated in FIG. 1, has the form of a composite member 10 which incorporates a plate portion 11 which is bonded to a flexible but non-stretchable layer 12, typically of polyester. Bonded to the underside of the layer 12 is a further layer 14 having controlled regions of different stiffnesses. In FIG. 1, the stippled region of the layer 14 represents a greater degree of stiffness than the non-stippled area. FIG. 1 shows a first region 16 which has an uninterrupted upper surface 18, which is intended to print a solid colour. Another region identified by the numeral 20 consists of individual "spikes" 22 having flat circular tops 24, which are intended to print the coloured dots utilized in the four-colour process printing technique. It will be seen that the layer 14 is not stippled under the region 20. Thus, the layer 14 is relatively stiff in the stippled area under the region 16 of the plate portion 11, whereas it is less stiff under the region 20.

FIG. 1 also illustrates a piece of tape 26 (having adhesive on both sides) which would typically be a relatively stiff material functionally only to adhere the plate cylinder 27 to the multi-layer composite member 10 consisting of layers 11, 12 and 14.

It will thus be understood that, when the plate printing portion 11 and the connected layers 12 and 14 are adhered or otherwise affixed to a plate cylinder with the double-sided tape 26, the region identified by the numeral 20 will not be urged as strongly against the substrate as the region identified by the numeral 16 (the word "substrate" used herein refers to the paper or web being printed).

The layer 14 could be made of a material selected on the basis of its photo-sensitivity, or the material of layer 14 could be one which ultimately becomes either more stiff or less stiff on the application of light, heat, x-radiation, other radiation, particle bombardment, vibration, chemical treatment, work hardening, and/or other forms of energy, or by another stiffness modifying process or processes.

Those skilled in the art will understand that there are means other than a two-sided tape by which the composite member 10 can be mounted to a plate cylinder. It will also be understood that a plate cylinder is only one of several different kinds of support to which the composite member 10 can be mounted. For example, the support may consist of the platen used in a flatbed letterpress system, a curved or semi-cylindrical support, or other known configurations.

Figure 2:
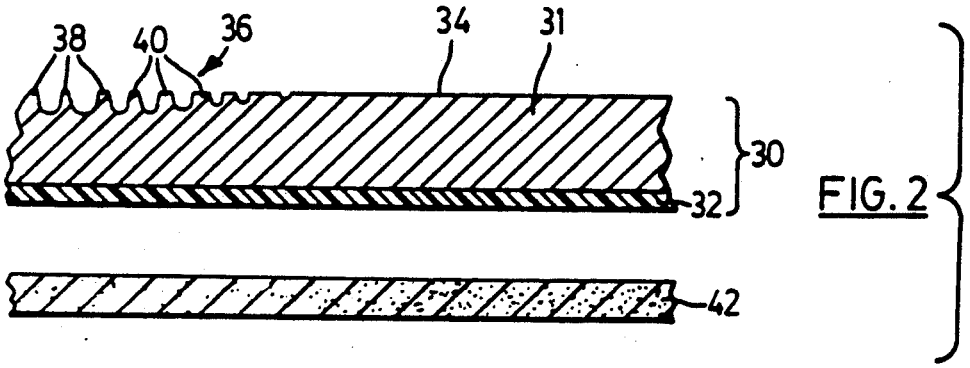
FIG. 2 is a sectional view through a second embodiment of this invention.

FIG. 2 shows an embodiment which has the form of a composite member 30 which includes a plate portion 31 and a flexible but non-stretchable layer 32 which may be of polyester or the like. These two layers are bonded together in the usual way.

The plate portion 31 incorporates a region identified by the numeral 34 which is unbroken and is intended to print a solid colour. The region 34 gradually merges into a region identified by the numeral 36, which contains spikes 38 having flat circular tops 40, which are intended to print the coloured dots utilized in process colour printing. Note that the sizes of the tops 40 gradually decrease from right to left in FIG. 2.

In the embodiment of FIG. 2, the variations in stiffness are provided in the tape layer 42. This material would be selected as one which either increases or decreases in stiffness with the application of radiation or other energy, or work, or stiffness modifying process. As can be seen in FIG. 2, the tape layer 42 is shown stippled under the region 34 to indicate relative stiffness. The stippling gradually fades toward and under the region 36, to indicate a progressively decreasing stiffness as the ink coverage decreases.

Figure 3:
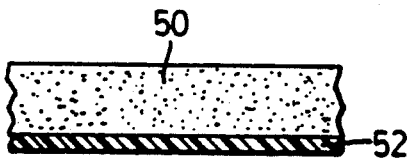
FIG. 3 is a sectional view through a third embodiment of this invention.

Attention is now directed to FIG. 3, which shows a plate with an upper layer 50 adhered to a flexible but non-stretchable layer 52, typically of polyester. Note that the material 50 is shown fully stippled, indicating that is has been made quite stiff. The portion shown in FIG. 3 is without dots or relieved areas, and thus is intended to print solid colour.

Figure 4:
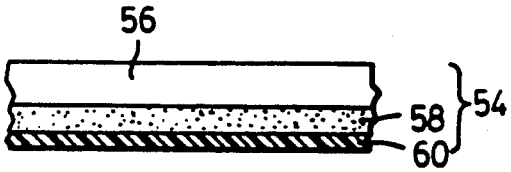
FIG. 4 is a sectional view through a fourth embodiment of this invention.

In the embodiment shown in FIG. 4, a composite member 54 is composed of an upper layer 56 and a lower layer 58. The lower layer 58 is secured to a flexible but non-stretchable layer 60, typically of polyester. In the FIG. 4 embodiment, as compared to that of FIG. 3, the stiffenable region is limited to the lower layer 58.

As with the first two embodiments, the embodiments of FIGS. 3 and 4 are such as to develop differential stiffness upon exposure to radiation or other energy or work or stiffness modifying process. In the case of the FIG. 3 embodiment, the same polymer or other material responds to energy or work or other process to change its relative stiffness and its relative capability to be etched. For the embodiment of FIG. 4, the variable stiffness is limited to the layer 58, while the upper layer 56 is intended to be etched.

It is conceivable that, with any of the embodiments shown in the figures, two or more exposures or procedures may have to be carried out. For example, the material of the plate portion 11 in FIG. 1 may be prepared using light of a certain wavelength, whereas the layer 14 may respond to light of a different wavelength. Furthermore, the two procedures or exposures may be carried out on the respective layers when they are separated, or when they are together.

It is important to realize that an exact proportionality between the stiffness factor and the degree of ink coverage may not represent the ideal construction. As a general rule, the less inked areas will correspond to a lower stiffness and the more inked areas will correspond to greater stiffness, however there are certain peculiarities in the printing process itself which may require something other than true proportionality. Also, there is a possibility that the provision of "stepped" stiffness regions will be not only acceptable but preferable.

While four embodiments of this invention have been illustrated in the accompanying drawings and described hereinabove, it will be evident to those skilled in the art that changes and modifications may be made therefrom, without departing from the essence of this invention, as set forth in the appended claims.

I claim:

1. For use in a raised image printing process employing a plate support, an improved plate construction comprising:

a plate portion having an upper printing surface for printing an image on a substrate, the image including areas of greater ink coverage and areas of lesser ink coverage;

attachment means for attaching the plate portion to the plate support so that said upper printing surface is uniformly spaced above said plate support, said attachment means being a two-sided tape of uniform thickness;

said two-sided tape having regions of greater stiffness under image areas of greater ink coverage and regions of lesser stiffness under image areas of lesser ink coverage, whereby greater contact pressure is applied under images of greater ink coverage, and lesser contact pressure is applied under areas of lesser ink coverage.

* * * * *